US005231854A

United States Patent [19]

Schmid et al.

[11] Patent Number: 5,231,854

[45] Date of Patent: Aug. 3, 1993

[54] TWO-BED FLAT KNITTING MACHINE HAVING NEEDLES AND SINKERS

[75] Inventors: Franz Schmid, Bodelshausen; Emil Föhl, Frickenhausen; Robert Kurz, Metzingen; Fritz Fleiner, Rottenburg, all of Fed. Rep. of Germany

[73] Assignee: H. Stoll GmbH & Co., Fed. Rep. of Germany

[21] Appl. No.: 932,500

[22] Filed: Aug. 21, 1992

[30] Foreign Application Priority Data

Aug. 23, 1991 [DE] Fed. Rep. of Germany ... 4128016[U]

[51] Int. Cl.[5] ..... D04B 15/06

[52] U.S. Cl. ..... 66/64; 66/106

[58] Field of Search ..... 66/64, 104, 109, 106

[56] References Cited

U.S. PATENT DOCUMENTS

| | | | |
|---|---|---|---|
| 557,641 | 4/1896 | Bennor | 66/109 |
| 3,735,812 | 5/1973 | Flavell et al. | 66/109 X |
| 4,713,948 | 12/1987 | Schmidt et al. . | |
| 4,827,739 | 5/1989 | Goller et al. | 66/64 |
| 5,134,864 | 8/1992 | Yabuta et al. | 66/106 |
| 5,138,849 | 8/1992 | Stoll et al. | 66/104 |

FOREIGN PATENT DOCUMENTS

| | | | |
|---|---|---|---|
| 0441564 | 8/1991 | European Pat. Off. | 66/104 |
| 0472341 | 2/1992 | European Pat. Off. . | |
| 1137825 | 10/1962 | Fed. Rep. of Germany . | |
| 3609539 | 10/1987 | Fed. Rep. of Germany . | |
| 3917934 | 12/1989 | Fed. Rep. of Germany . | |

OTHER PUBLICATIONS

ITMA '91—Erwartungen aus japanischer Sicht, Von K. Myohdai, Wirkerei—und Strickerei-Technik 14 (1991) 6.

*Primary Examiner*—Clifford D. Crowder
*Assistant Examiner*—John J. Calvert
*Attorney, Agent, or Firm*—Larson and Taylor

[57] ABSTRACT

The sinkers (15) which are used together with the needles of a two-bed flat knitting machine and which are located opposite one another in the needle beds (1, 2) have an upper projection (17) and a lower projection (18) which, in one of their positions, both have a retaining effect on the stitches or stitch rows made.

12 Claims, 1 Drawing Sheet

TWO-BED FLAT KNITTING MACHINE HAVING NEEDLES AND SINKERS

The invention relates to a two-bed flat knitting machine which has needles longitudinally displaceable in their needle beds and sinkers which are adjustable between a rear and a front position and which are controlled respectively by cam parts of the carriage, the sinkers of one needle bed being located opposite the sinkers of the other needle bed and possessing, level with the stitch-forming region, an upper projection which is movable into the comb gap and which has at least one edge influencing the processed yarn.

Flat knitting machines having the abovementioned features are known, for example, from German Patent Specification 3,609,539 (or U.S. Pat. No. 4,713,948) and German Offenlegungsschrift 3,935,763 (or U.S. Pat. No. 5,38,849) of the applicant. The sinkers of these flat knitting machines ensure that the so-called old stitches are held down reliably while the needles are being driven out to pick up the yarn in order to form new stitches or tuck loops. The sinkers perform the function of conventional feeders, which become unnecessary. The problem of holding down the stitches when the needles are being driven out occurs to an increased extent in the production of fully-fashioned knitted fabric, in which fabric portions of differing density occur in the comb gap, as seen over its length, and, in the regions with a high stitch accumulation, the problem of holding down the stitches comes sharply to the fore.

The object on which the invention is based is to design the sinkers of a two-bed flat knitting machine of the type mentioned in the introduction, in such a way that, even during the formation of bulky fabrics, they reliably eliminate the risk of stitch-forming faults in the stitch-forming region of the flat knitting machine.

According to the invention, with the two-bed flat knitting machine mentioned, the set object is achieved in that the sinkers additionally possess at least one lower projection which is movable out of the needle bed into the fabric draw-off region as far as contact with the fabric formed.

This lower sinker projection achieves, in addition to the retaining effect of the upper projection, a clamping effect on the freshly formed fabric immediately below the stitch-forming region of the flat knitting machine, that is to say in a region in which the fabric draw-off device of the flat knitting machines cannot yet exert the best possible effect.

Advantageously, the lower projection of the sinkers can have a non-rectilinear front edge forming individual bosses and can be so guided that, during the inward movement of the sinkers into the fabric draw-off region, at least one of the bosses acquires a movement component in the fabric draw-off direction, that is to say the sinker not only performs a retaining function, but also assists the work of the fabric draw-off device of the flat knitting machine. The guidance of the sinkers and the mutual arrangement of the upper and lower sinker projections can be selected so that, on the one hand, a sufficient retaining effect of the two projections is achieved, but on the other hand a sufficient slackening of this retaining effect for a shift of the needle bed can be obtained.

An additional advantage can also be achieved if the sinkers are provided with a large edge recess between the upper projection and the lower projection, so that the head of an adjacent needle of the same needle bed is free on the sinker side into its lowest draw-off position. Additional free space for the head of a newly formed stitch is thereby provided, this being conducive to subsequently driving out the needle, without the newly formed stitch being undesirably pulled with it.

An exemplary embodiment of a sinker designed according to the invention for a two-bed flat knitting machine is explained in more detail below by means of the accompanying drawing.

In the drawing, in particular:

Figure 1:
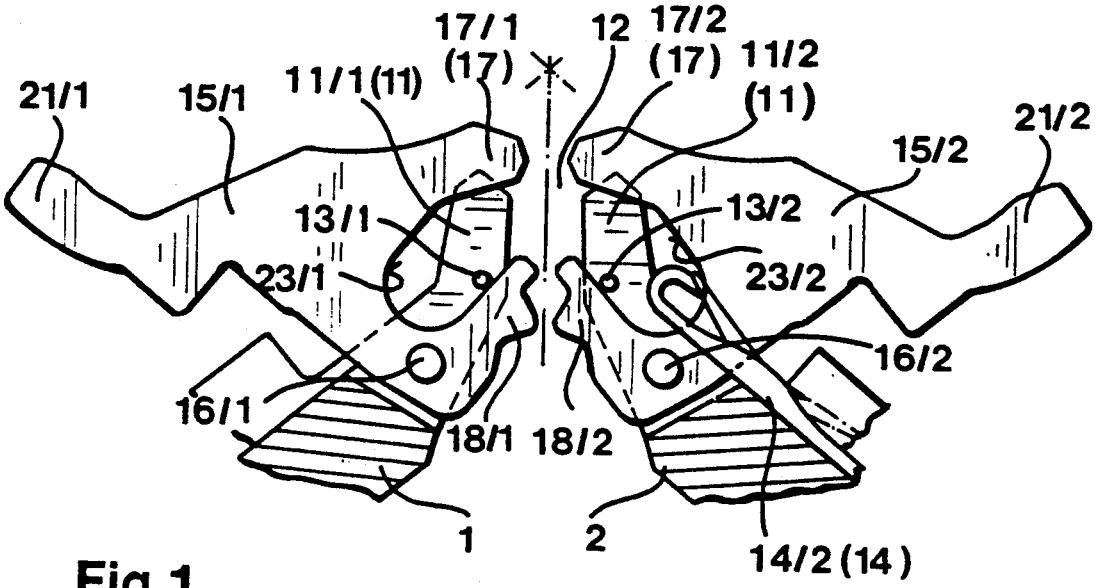
FIG. 1 shows a part cross-section through the two needle beds of a flat knitting machine in the region of the comb gap of the machine, with sinkers in a releasing position.

The two part-sectional representations of the drawing show the two needle beds 1 and 2 of the flat knitting machine which terminate respectively in stitch-forming webs 11/1 and 11/2 which limit the comb gap 12 between the two needle beds. The drawing also shows, in section, wires 13/1 and 13/2 which are guided parallel to the comb gap 12 through orifices of the stitch-forming webs 11/1 and 11/2 over the entire length of a needle bed and which form the stitch knock-over edges of the needle beds 1 and 2. Shown in the needle bed 2 is one of the needles 14/2 mounted so as to be longitudinally adjustable there. Between the needles 14 of the two needle beds 1, 2 and their stitch-forming webs 11/1, 11/2, knock-over sinkers 15/1 and 15/2 are mounted pivotably in the needle beds about respective bearing journals 16/1, 16/2. The sinkers 15/1 and 15/2 of the two needle beds are of identical design and are located opposite one another in pairs. Each sinker has an upper projection 17/1 or 17/2 and a lower projection 18/1 or 18/2 which are respectively formed on the same sides of the bearing journals 16/1, 16/2, and consequently both are movable in the same direction into the comb gap 12 of the flat knitting machine out of a releasing position shown in FIG. 1 into a retaining position evident from FIG. 2 and back again.

Figure 2:
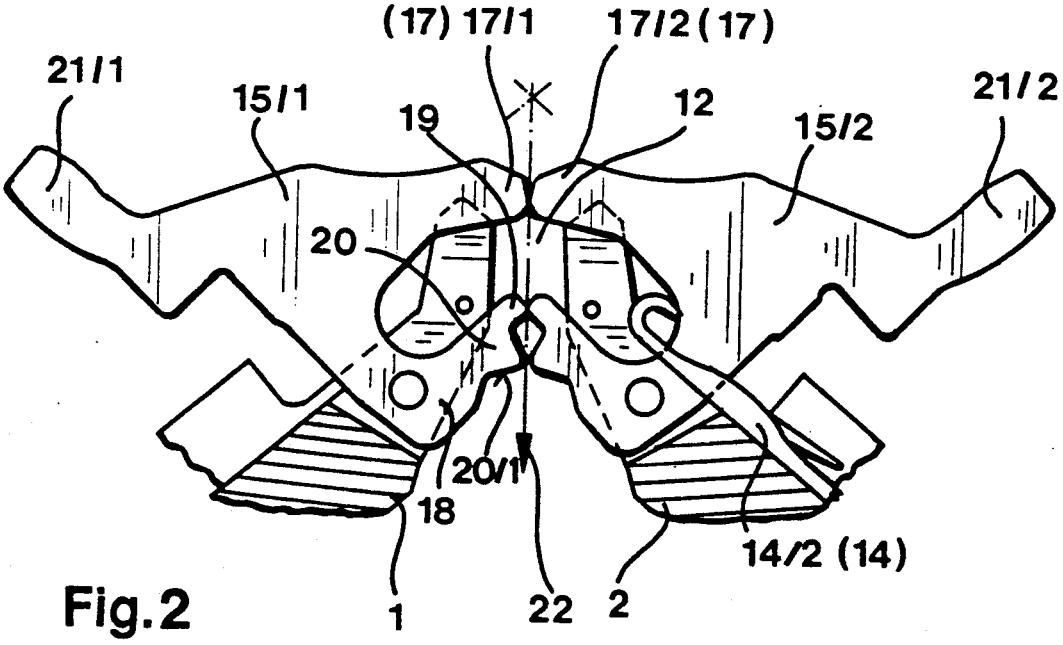
FIG. 2 shows a representation corresponding to that of FIG. 1, with the sinkers in a retaining position.

The front edge of the lower projection 18/1 or 18/2 of the sinkers 15/1 or 15/2 is non-rectilinear and is so designed as to produce two bosses 19, 20 which, for the sake of clarity, are designated only on the sinker 15/1 of the needle bed 1 in FIG. 2. As is also evident from FIG. 2, the sinkers 15/1 and 15/2 located opposite one another can pivot on their control feet 21/1, 21/2 until they are located with their upper projections 17/1, 17/2 opposite one another and form a bridge spanning the comb gap 12. In the exemplary embodiment illustrated, the lower projections 18 of the two sinkers are designed so that the two bosses 19 of the mutually opposite sinkers 15/1, 15/2 also come to bear against one another and, during the inward pivoting of the sinkers, one edge 20/1 of the boss 20 of the lower projection 18 of the sinkers acquires a downward movement component in the draw-off direction, indicated by an arrow 22, of the fabric formed. The lower projections 18/1 and 18/2 of the mutually interacting sinkers 15/1 and 15/2 grasp the freshly formed fabric stitch rows with their projections 19, 20, prevent them from creeping upward into the comb gap 12 and, during the inward pivoting of the sinkers, also impart to them an additional advancing movement in the fabric draw-off direction.

The sinkers 15/1, 15/2 have a large edge recess 23/1, 23/2 between their upper projection 17/1, 17/2 and their lower projection 18/1, 18/2. This ensures that the heads of the adjacent needles 14 are free towards the sinker side into their lowest draw-off position, which is shown in FIG. 1 by a needle 14/2 of the needle bed 2. FIG. 2 shows the needle 14/2 at the start of its driving-out movement, by means of which the mutually opposite sinkers 15/1 and 15/2 maintain their retaining position evident from FIG. 2.

The sinkers do not have to have the form and function illustrated in the drawing. They can also be designed as combined loop-forming and knock-over sinkers which with their upper projections 17 also perform the function of the stitch-forming webs 11 and which are correspondingly equipped with a loop-forming edge. The stitch-forming webs 11 of the needle beds can then be omitted. The sinkers 15 can also be designed so that neither the upper nor the lower sinker projections 17, 18 touch one another in the retaining position, since, even then, a clamping effect of the lower projections 20 on the newest stitch rows of the fabric is still obtained in the retaining position of the sinkers. The sinkers can also be arranged adjustably along a curved path and not pivotably about an axis.

What is claimed is:

1. A two-bed flat knitting machine including a carriage for forming a fabric from yarn processed thereby comprising:

two adjacent needle beds which together form a stitch-forming region for the fabric, a fabric draw-off region, and a comb gap therebetween;

each of said needles beds including needles longitudinally displaceable in the respective said bed, and sinkers associated with said needles, with receptive said sinkers of said two needle beds being located opposite one anther in pairs, said sinkers being controlled by cam parts of the carriage for movement between a releasing position and a retaining position;

each said sinker including an upper projection level with the stitch-forming region which is moved into the comb gap when said sinker is moved to the retaining position, said upper projection having at least one edge influencing the processed yarn in the retaining position, and at least one lower projection which is moved of the needle bed and into the fabric draw-off region when said sinker is moved from the releasing position to the retaining position so that the fabric formed is held between opposed said sinkers of said needle beds.

2. A two-bed flat knitting machine as claimed in claim 1 wherein said lower projections of said sinkers include a non-linear front edge having at least two bosses thereon, one of said bosses being formed to have a movement component in a fabric draw-off direction when the associated said sinker is moved inwardly to the fabric draw-off region.

3. A two-bed flat knitting machine as claimed in claim 1 wherein respective said sinkers of each said needle bed are mounted pivotally about a common axis, and wherein said upper projection and said lower projection of each said sinker are located on a same side of the associated pivot axis whereby said projections pivot in a same direction.

4. A two-bed flat knitting machine as claimed in claim 1 wherein each said sinker includes a large recess between said upper projection and said lower projection such that a head of said needle associated therewith is free of the associated said sinker in a lowest draw-off position of said needle.

5. A two-bed flat knitting machine as claimed in claim 1 wherein said sinkers of a said needle bed are arranged between two associated said needles of the said bed, and wherein each said upper projection include a loop-forming edge.

6. A two-bed flat knitting machine as claimed in claim 1 wherein said sinkers are arranged between an associated said needle and a stationary stitch-forming web of the associated said needle bed, and wherein said stitch-forming web includes a loop-forming edge.

7. A two-bed flat knitting machine as claimed in claim 1 wherein said upper projections of opposite said sinkers are formed to come together when said sinkers are in the retaining position to form a bridge spanning the comb gap.

8. A two-bed flat knitting machine as claimed in claim 4 wherein said lower projections of said sinkers include a non-linear front edge having at least two bosses thereon, one of said bosses being formed to have a movement component in a fabric draw-off direction when the associated said sinker is moved inwardly to the fabric draw-off region.

9. A two-bed flat knitting machine as claimed in claim 8 wherein respective said sinkers of each said needle bed are mounted pivotally about a common axis, and wherein said upper projection and said lower projection of each said sinker are located on a same side of the associated pivot axis whereby said projections pivot in a same direction.

10. A two-bed flat knitting machine as claimed in claim 9 wherein said sinkers of a said needle bed are arranged between two associated said needles of the said bed, and wherein each said upper projection includes a loop-forming edge.

11. A two-bed flat knitting machine as claimed in claim 10 wherein said sinkers are arranged between an associated said needle and a stationary stitch-forming web of the associated said needle bed, and wherein said stitch-forming web includes a loop-forming edge.

12. A two-bed flat knitting machine as claimed in claim 11 wherein said upper projections of opposite said sinkers are formed to come together when said sinkers are in the retaining position to form a bridge spanning the comb gap.

* * * * *